US006416882B1

(12) United States Patent
Beele et al.

(10) Patent No.: US 6,416,882 B1
(45) Date of Patent: Jul. 9, 2002

(54) PROTECTIVE LAYER SYSTEM FOR GAS TURBINE ENGINE COMPONENT

(75) Inventors: Wolfram Beele, Ratingen; Beate Heimberg, Berlin, both of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/562,876

(22) Filed: May 1, 2000

Related U.S. Application Data

(63) Continuation of application No. PCT/DE98/03092, filed on Oct. 21, 1998, now abandoned.

(30) Foreign Application Priority Data

Nov. 3, 1997 (DE) ..... 197 48 506

(51) Int. Cl.[7] ..... C23C 4/08; C23C 30/00

(52) U.S. Cl. ..... 428/633; 428/469; 428/472; 428/621; 428/632; 428/697; 428/699; 428/701; 428/702

(58) Field of Search ..... 428/472, 469, 428/701, 697, 699, 702, 621, 632, 633

(56) References Cited

U.S. PATENT DOCUMENTS

| | | | |
|---|---|---|---|
| 4,321,310 A | 3/1982 | Ulion et al. | 428/612 |
| 4,339,509 A | 7/1982 | Dardi et al. | 428/632 |

(List continued on next page.)

FOREIGN PATENT DOCUMENTS

| | | |
|---|---|---|
| DE | 3543802 | 6/1987 |
| EP | 0223083 | 5/1987 |

(List continued on next page.)

OTHER PUBLICATIONS

Sivakumar, R., et al., "On the Development of Plasma–Sprayed Thermal Barrier Coatings," *Oxidation of Metals*, vol. 20, Nos. 3/4, pp. 67–73 (1983) (No Month).

(List continued on next page.)

*Primary Examiner*—Archene Turner
(74) *Attorney, Agent, or Firm*—David M. Quinlan, P.C.

(57) ABSTRACT

An article that is particularly well suited for use as a gas turbine engine component has a ceramic thermal insulation layer overlaying a bonding layer. The bonding layer is an alloy comprising iron, cobalt and/or nickel and either:

the following group 1 elements (by weight percent):
Chromium: 3% to 50%
Aluminum: 3% to 20%
Yttrium and/or a rare-earth element: 0.01% to 0.5%
Lanthanum: 0.1% to 10%
Hafnium: 0 to 10%
Magnesium: 0 to 10%
Silicon: 0 to 2%, or the following group 2 elements (by weight percent):
Chromium: 3% to 50%
Aluminum: 3% to 20%
Yttrium and/or a rare-earth element: 0 to 0.5%
Lanthanum: 0.1% to 10%
Hafnium: 0.1% to 10%
Magnesium: 0 to 10%
Silicon: 0 to 2%.

16 Claims, 1 Drawing Sheet

U.S. PATENT DOCUMENTS

| | | | | | |
|---|---|---|---|---|---|
| 4,585,481 | A | | 4/1986 | Gupta et al. | 106/14.05 |
| 4,764,341 | A | | 8/1988 | Flaitz et al. | 419/9 |
| 4,971,839 | A | | 11/1990 | Rohr et al. | 427/372.2 |
| 4,996,117 | A | | 2/1991 | Chu et al. | 428/633 |
| 5,032,557 | A | | 7/1991 | Taira et al. | 501/135 |
| 5,154,885 | A | | 10/1992 | Czech et al. | 420/588 |
| 5,236,787 | A | | 8/1993 | Grassi | 428/552 |
| 5,401,307 | A | | 3/1995 | Czech et al. | 106/14.05 |
| 5,466,280 | A | | 11/1995 | Lee et al. | 106/14.12 |
| 5,512,382 | A | | 4/1996 | Strangman | 428/632 |
| 5,652,028 | A | * | 7/1997 | Taylor et al. | 427/451 |
| 5,741,556 | A | * | 4/1998 | Taylor et al. | 427/453 |

FOREIGN PATENT DOCUMENTS

| | | | |
|---|---|---|---|
| EP | 0486489 | | 2/1991 |
| GB | 2243161 | | 10/1991 |
| GB | 2286977 | | 9/1995 |
| JP | 5393134 | | 8/1978 |
| JP | 3226553 | | 10/1991 |
| JP | 4036453 | | 2/1992 |
| JP | 4231451 | | 8/1992 |
| JP | 4231452 | | 8/1992 |
| JP | 5279832 | | 10/1993 |
| WO | WO 9102108 | | 2/1991 |
| WO | WO 9635826 | | 11/1996 |
| WO | 98-04759 | * | 2/1998 |

OTHER PUBLICATIONS

Yagodkin, Y.D., et al., "Application of Ion–Beam Treatment in Turbine Blade Production Technology," *Surface and Coatings Technology*, vol. 84, pp. 590–592 (1996) No Month.

Internationalen Recherchenbericht (International Search Report) in PCT/DE98/03092, Mar. 25, 1999, No Date.

Internationalen Rechenchenbericht (International Search Report) in PCT/DE98/03205, Mar. 31, 1999, No Date.

Internationalen Vorläufigen Prüfungsberichts (International Preliminary Examination Report) in PCT/DE98/03092, Sep. 14, 1999.

Internationalen Vorläufigen Prüfungsberichts (International Preliminary Examination Report) in PCT/DE98/03205, Nov. 22, 1999.

* cited by examiner

PROTECTIVE LAYER SYSTEM FOR GAS TURBINE ENGINE COMPONENT

CROSS-REFERENCE TO RELATED APPLICATIONS

This application is a continuation of International Application PCT/DE98/03092, with an international filing date of Oct. 21, 1998, now abandoned.

BACKGROUND OF THE INVENTION

1. Field of the Invention

The present invention relates to a protective coating for an article exposed to hot, aggressive gas flows and, more particularly, to a layer for bonding a protective layer to a gas turbine engine component.

2. Description of Related Art

Gases flowing through a turbine engine reach extremely high temperatures and velocities. It is a significant engineering challenge to build components that will withstand the impingement of a high velocity gas at temperatures that can exceed 1000° C. The demands on an engine's turbine blades are particularly extreme, because they are exposed to high velocity, high temperature gases while being subjected to the forces resulting from rotation at thousands of revolutions per minute.

Prior art turbine blades are typically a laminated structure, with a so-called superalloy substrate having a heat resistant coating. These superalloys are typically cobalt- or nickel-based materials, and the protective coatings have taken a variety of forms. One known component of such coatings is an MCrAlY alloy, where Cr is chromium, Al is aluminum and Y is yttrium and/or a rare-earth element, with the remainder M selected from the group consisting of iron, cobalt, nickel or mixtures thereof.

EP 486 489 (U.S. Pat. No. 5,401,307) is an example of a prior art corrosion-resistant protective coating for medium and high temperatures up to about 1050° C. for a gas turbine part made of a nickel-based or cobalt-based alloy. The protective coating has, in percentages by weight, 25% to 40% nickel, 28% to 32% chromium, 7% to 9% aluminum, 1% to 2% silicon and 0.3% to 1% of at least one reactive rare-earth element, at least 5% cobalt and selectively from 0 to 15% of at least one element from the group consisting of rhenium, platinum, palladium, zirconium, manganese, tungsten, titanium, molybdenum, niobium, iron, hafnium and tantalum. In the disclosed embodiments, the protective coating merely comprises the elements nickel, chromium, aluminum, silicon, yttrium and additional rhenium in a range of 1% to 15%, the remainder being made up of cobalt. The corrosion properties are improved considerably by the addition of rhenium.

U.S. Pat. No. 4,321,310 is another example of such prior art. It describes a gas turbine component which has a base body made of the nickel-based superalloy MAR-M-200. A layer of an MCrAlY alloy, in particular an NiCoCrAlY alloy, having 18% chromium, 23% cobalt, 12.5% aluminum and 0.3% yttrium, with the remainder being made up of nickel, is applied to the base material. This alloy layer has a polished surface, to which an aluminum oxide layer is applied. A ceramic thermal insulation layer, which has a columnar structure, is applied to this aluminum oxide layer.

U.S. Pat. No. 4,585,481 likewise uses protective layers for protecting a superalloy metallic substrate against high-temperature oxidation and corrosion. MCrAlY alloys are employed for the protective layers, and the patent discloses such layers with 5% to 40% chromium, 8% to 35% aluminum, 0.1% to 2% of an oxygen-active element from group IIIb of the periodic table, including the lanthanides and actinides and mixtures thereof, 0.1% to 7% silicon and 0.1% to 3% hafnium, the remainder being made up of nickel and/or cobalt. The corresponding protective layers made of MCrAlY alloys are, according to this patent, applied using a plasma-spray method.

Yagodkin, Y. D., et al., "Application of Ion-Beam Treatment in Turbine Blade Production Technology," *Surface and Coatings Technology,* Vol. 84, pp. 590–592 (1996), disclose doping protective layers of NiCrAlY- or NiCoCrAlY-type alloys with boron or lanthanum by exposure to ion beams. The protective layers are in this case applied to a nickel-based superalloy. No information has been found in this article regarding the magnitude of the possible degree of doping.

WO 96/35826 Al discloses a thermal insulation layer for a superalloy turbine rotor blade that is exposed to hot gas during operation. The thermal insulation layer has a ceramic protective layer bonded to an adhesion layer made up of an aluminide or an MCrAlY-type alloy. The superalloy may either be MAR-M247, a nickel-based alloy with a proportion of hafnium, or MAR-M509, a cobalt-based alloy with a proportion of zirconium. The adhesion layer is an MCrAlY alloy having a content of 10% to 35% chromium, 5% to 15% aluminum and 0.01% to 1% of one of the elements yttrium, hafnium or lanthanum, that lies over the superalloy substrate. According to this document, the oxidation of aluminum in the adhesion layer gives rise to an aluminum oxide layer which makes it possible for the ceramic protective layer to bind to the adhesion layer. In this case, partially stabilized zirconium is used as the ceramic protective layer, such stabilization being carried out using calcium oxide, magnesium oxide, cerium oxide or yttrium oxide.

However, those skilled in the art still seek a better system to protect articles subjected to erosion by hot, aggressive gases, such as gas turbine engine components.

SUMMARY OF THE INVENTION

It is an object of the present invention to avoid the shortcomings of prior art structure for protecting articles in demanding environments, and particularly to provide a layer system for protecting gas turbine engine components such as turbine blades.

It is another object of the present invention to provide a product having a metallic base body having thereon a bonding layer with an alloy for binding to it a thermal insulation layer, particularly one comprising a ternary oxide.

In furtherance of the objects of the present invention, one aspect of the invention involves an article having a metallic substrate with a layer system thereon including a ceramic thermal insulation layer and a bonding layer between the ceramic thermal insulation layer and the substrate, wherein the bonding layer is an alloy comprising at least one element from the group comprising iron, cobalt and nickel, and the elements of at least one of a group 1 and a group 2, wherein:

group 1 comprises the following elements (expressed in percentages by weight):

Chromium: 3% to 50%
Aluminum: 3% to 20%
Yttrium and/or a rare-earth element: 0.01% to 0.5%
Lanthanum: 0.1% to 10%
Hafnium: 0 to 10%
Magnesium: 0 to 10%
Silicon: 0 to 2%; and group 2 comprises the following elements (expressed in percentages by weight):

Chromium: 3% to 50%

Aluminum: 3% to 20%

Yttrium and/or a rare-earth element: 0 to 0.5%

Lanthanum: 0.1% to 10%

Hafnium: 0.1% to 10%

Magnesium: 0 to 10%

Silicon: 0 to 2%.

The invention is particularly adapted for use with a component of a gas turbine engine such as a turbine blade, a guide vane or a heat shield element, in which the component is a nickel- or cobalt-based alloy.

BRIEF DESCRIPTION OF THE DRAWINGS

Exemplary embodiments of the invention are explained in more detail with reference to two figures, in which.

Figure 2:
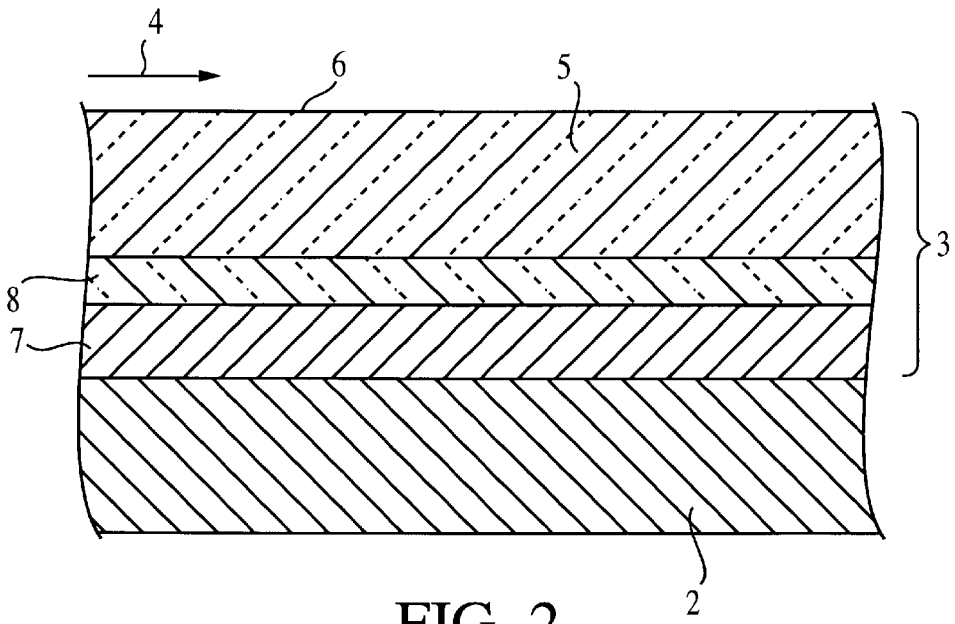
FIG. 2 is a sectional view through the blade taken at the line II—II in FIG. 1.

In the drawings, the same components are given the same reference numbers or letters in the different figures. It will be understood that the drawings illustrate exemplary embodiments diagrammatically and are not necessarily drawn to scale, in order to better represent the features of the embodiments described herein.

DETAILED DESCRIPTION OF PREFERRED EMBODIMENTS

Figure 1:
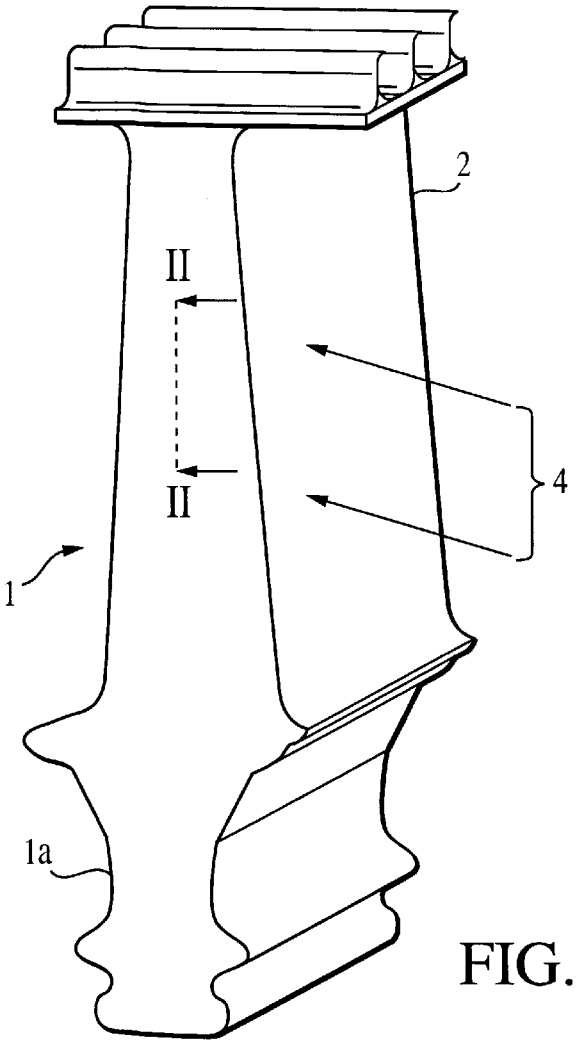
FIG. 1 is a perspective representation of a gas turbine engine turbine blade.

Referring to FIGS. 1 and 2, the turbine blade 1 has a metallic base or substrate 2 of a conventional nickel- or cobalt-based superalloy. The blade 1 includes a root section 1*a* that holds the blade 1 in place in a turbine rotor (not shown) in the conventional manner. A layer system 3 on the substrate 2 protects the blade from hot gases 4 impinging on the blade during operation of the gas turbine engine of which the blade is a part.

As is seen more clearly in FIG. 2, the outermost component of the layer system 3 is a thermal insulation layer 5, preferably comprising a ternary oxide. The hot aggressive gases 4 impinge on the outer surface 6 of the thermal insulation layer 5, but they are effectively separated physically and chemically from the blade's metallic substrate body 2 by the layer system 3.

In accordance with the present invention, the layer system 3 includes a bonding layer 7 applied to the substrate 2. The bonding layer 7 is an alloy described in detail below. A binding layer 8 made up of lanthanum-containing binding oxides is formed between the bonding layer 7 and the thermal insulation layer 5, in particular by oxidation of the bonding layer 7. In consequence of this, good binding of the thermal insulation layer 5 to the metallic substrate 2 takes place via the bonding layer 7. As a result, considerable improvement in the life of the gas turbine blade 1 is achieved.

The bonding layer 7 comprises an alloy with one of two possible compositions. The first alloy according to the present invention comprises the following elements (in percentages by weight):

Chromium: 3% to 50%

Aluminum: 3% to 20%

Yttrium and/or a rare-earth element: 0.01% to 0.5%

Lanthanum: 0.1% to 10%

Hafnium: 0 to 10%

Magnesium: 0 to 10%

Silicon: 0 to 2%

At least one element from the group comprising iron, cobalt and nickel.

The second alloy according to the present invention comprises the following elements (in percentages by weight):

Chromium: 3% to 50%

Aluminum: 3% to 20%

Yttrium and/or a rare-earth element: 0 to 0.5%

Lanthanum: 0.1% to 10%

Hafnium: 0.1% to 10%

Magnesium: 0 to 10%

Silicon: 0 to 2%

At least one element from the group comprising iron, cobalt and nickel.

The bonding layer thus comprises an MCrAlY-type alloy having a supplement of 0.1% to 10% lanthanum and 0.01% to 0.5% yttrium and/or 0.1% to 10% hafnium. The alloy may advantageously comprise such elements in the following ranges: lanthanum—0.5% to 10%, hafnium—0.5% to 10%, and yttrium—0.1% to 0.5%.

Owing to the addition of lanthanum, the bonding layer is not only suitable for binding to the base body common thermal insulation layers, in particular thermal insulation layers, having zirconium oxide partially stabilized, for example, with yttrium oxide. It is also suitable for binding ceramic thermal insulation layers comprising ternary oxides.

Such ternary oxides contain oxygen as the third element and, preferably, nickel, magnesium or cobalt as the first element and aluminum or chromium as the second element. In an alternative composition, the first element of the ternary oxide is calcium or lanthanum and the second element is aluminum, zirconium or hafnium. An advantageous ceramic insulation layer is disclosed in U.S. application Ser. No. 09/562,877 filed on even date herewith and corresponding to International Application No. PCT/DE98/03205.

In such ternary oxides, the bonding layer 7 makes it possible to produce a chemically suitable interface-compound. This good binding to a ternary oxide thermal insulation layer is achieved by virtue of lanthanum oxide produced as a result of oxidation of the bonding layer and hafnium oxide which may additionally be produced. Through oxidation of the lanthanum-containing bonding layer, a thermally grown intermediate layer of lanthanum-containing binding oxides, to which the thermal insulation layer binds well, can be produced on the bonding-layer surface on the opposite side from the base body. This intermediate binding layer 8 may comprise, besides lanthanum oxide ($La_2O_3$), aluminum oxide ($Al_2O_3$), chromium oxide ($Cr_2O_3$) and/or hafnium oxide ($HfO_2$). In addition, an intermediate binding layer can be also produced in accordance with the present invention as a separate layer using a coating method.

One preferred alloy for the bonding layer 7 has the following composition (in percentages by weight):

Chromium: 15% to 25%

Aluminum: 10% to 20%

Yttrium: 0.01% to 0.3%

Lanthanum: 0.1% to 2%

Hafnium: 0.1% to 2%

Magnesium: None (except for impurities introduced by the production process)

Silicon: None (except for impurities introduced by the production process)

The remainder being made up of nickel.

An alternative embodiment has the composition listed immediately above, except that the proportion of lanthanum is 0.1% to 5%, the proportion of hafnium is 0 to 2%, the proportion of magnesium is 0.1% to 2%, and the proportion of silicon is 0 to 2%.

In another alternative preferred embodiment, the alloy of the bonding layer 7 has the following composition (in percentages by weight):

Chromium: 3% to 15%

Aluminum: 3% to 10%

Yttrium: 0.01% to 0.3%

Lanthanum: 0.5% to 10%

Hafnium: 0 to 10%

Magnesium: 0 to 2%

Silicon: None (except for impurities introduced by the production process)

Cobalt: 0 to 33%

The remainder being made up of nickel.

It is in this embodiment possible for a further rare-earth element, scandium or a lanthanide element such as cerium, to be used instead of or besides yttrium. In certain cases, an actinide element may also be alloyed.

In a further preferred embodiment, the alloy of the bonding layer 7 has the following composition (in percentages by weight):

Chromium: 15% to 25%

Aluminum: 10% to 20%

Yttrium: 0.01% to 0.3%

Lanthanum: 0.5% to 2%

Hafnium: 0.5% to 2%

Magnesium: None (except for impurities introduced by the production process)

Silicon: None (except for impurities introduced by the production process)

Cobalt: 0 to 33%

The remainder being made up of nickel.

An alternative embodiment has the composition listed immediately above, except that the proportion of lanthanum is 0.5% to 5%, the proportion of magnesium is 0.1% to 2%, and the proportion of silicon is 0 to 2%.

In another alternate embodiment, the alloy of the bonding layer 7 has following composition (in percentages by weight):

Chromium: 3% to 15%

Aluminum: 3% to 10%

Yttrium: 0.01% to 0.3%

Lanthanum: 0.5% to 10%

Hafnium: 0.5% to 10%

Magnesium: 0 to 2%

Silicon: None (except for impurities introduced by the production process)

Cobalt: 0 to 33%

The remainder being made up of nickel.

In yet another alternative embodiment, the lanthanum content is in excess of 5%, preferably between 5% and 10%. The proportion of chromium is between 3% and 15%, that of aluminum is between 3% and 10%, that of hafnium is between 2% and 10%, that of magnesium is between 0 and 10%, that of yttrium is between 0.01% and 0.5%, that of silicon is between 0 and 2%, with the remainder being made up of cobalt, nickel or a mixture thereof.

It is preferred that the alloy of the bonding layer comprise the elements lanthanum, hafnium and yttrium and, if desired, other rare-earth elements, in a proportion by weight of more than 2%. At least two of lanthanum, hafnium and yttrium are present simultaneously in the alloy up to a proportion by weight of 5%. An alloy having at least one of yttrium and hafnium, and a proportion by weight of more than 5% lanthanum, in addition to being particularly suited to binding a ternary oxide, is also suitable for binding conventional thermal insulation materials based on zirconium oxide.

It will be appreciated that the present invention is useful in any environment in which an article is subject to hot, aggressive gas flows. It is particularly useful for components of gas turbine engines, such as turbine blades, guide vanes or a heat-shield elements. As noted above, it is particularly adapted as a bonding layer on a substrate of a nickel- or cobalt-based alloy.

Although preferred embodiments of the invention have been depicted and described, it will be understood that various modifications and changes can be made other than those specifically mentioned above without departing from the spirit and scope of the invention, which is defined solely by the claims that follow.

What is claimed is:

1. An article having a metallic substrate with a layer system thereon including a ceramic thermal insulation layer and a bonding layer between said ceramic thermal insulation layer and said substrate, wherein said bonding layer is an alloy comprising at least one element from the group comprising iron, cobalt and nickel, and the following elements (expressed in percentages by weight):

Chromium: 3% to 50%

Aluminum: 3% to 20%

Yttrium and/or a rare-earth element: 0% to 0.5%

Lanthanum: 0.1% to 10%

Hafnium: 0 to 10%

Magnesium: 0.1% to 10%

Silicon: 0 to 2%.

2. An article according to claim 1, wherein said alloy has the following composition (in percentages by weight):

Chromium: 15% to 25%

Aluminum: 10% to 20%

Yttrium: 0.01% to 0.3%

Lanthanum: 0.1% to 5%

Hafnium: 0 to 2%

Magnesium: 0.1% to 2%

Silicon: 0 to 2%, the remainder being made up of nickel.

3. An article according to claim 1, wherein said alloy has the following composition (in percentages by weight):

Chromium: 15% to 25%

Aluminum: 10% to 20%

Yttrium: 0.01% to 0.3%

Lanthanum: 0.5% to 5%

Hafnium: 0.5% to 2%

Magnesium: 0.1% to 2%

Silicon: 0 to 2%

Cobalt: 0 to 33%, the remainder being made up of nickel.

4. An article having a metallic substrate with a layer system thereon including a ceramic thermal insulation layer and a bonding layer between said ceramic thermal insulation layer and said substrate, wherein said bonding layer is an alloy comprising at least one element from the group comprising iron, cobalt and nickel, and the following elements (expressed in percentages by weight):

Chromium: 15% to 25%

Aluminum: 10% to 20%

Yttrium and/or a rare-earth element: 0% to 0.5%

Lanthanum: 0.1% to 5%

Hafnium: 0 to 2%

Magnesium: 0.1% to 2%

Silicon: 0 to 2%.

5. An article according to claim 4, wherein said alloy includes at least 0.01% yttrium and/or other rare earth element.

6. An article having a metallic substrate with a layer system thereon including (i) a ceramic thermal insulation layer comprising a ternary oxide with oxygen as a third element, (ii) a bonding layer between said ceramic thermal insulation layer and said substrate, wherein said bonding layer is an alloy comprising at least one element from the group comprising iron, cobalt and nickel, and the following elements (expressed in percentages by weight):

Chromium: 3% to 50%,

Aluminum: 3% to 20%,

Yttrium and/or a rare-earth element: 0% to 0.5%,

Lanthanum: 0.1% to 10%,

Hafnium: 0 to 10%,

Magnesium: 0% to 10%,

Silicon: 0 to 2%; and (iii) a binding layer between said ceramic thermal insulation layer and said bonding layer, said binding layer comprising lanthanum oxide in combination with at least one of aluminum oxide, chromium oxide and hafnium oxide.

7. An article according to any one of claims 1, 3, 4 and 5, wherein said thermal insulation layer comprises a ternary oxide with oxygen as a third element.

8. An article according to claim 7, wherein a first element of said ternary oxide is one of nickel, magnesium and cobalt, and a second element of said ternary oxide is one of aluminum and chromium.

9. An article according to claim 7, wherein a first element of said ternary oxide is one of calcium and lanthanum, and a second element of said ternary oxide is one of aluminum, zirconium and hafnium.

10. An article according to claim 7, further comprising a binding layer between said ceramic thermal insulation layer and said bonding layer, said binding layer comprising lanthanum oxide in combination with at least one of aluminum oxide, chromium oxide and hafnium oxide.

11. An article according to any one of claims 1, 3, 4 and 5, wherein said article is a one of a turbine blade, a guide vane and a heat shield element for a gas turbine engine.

12. An article according to claim 11, wherein said substrate comprises one of a nickel-based alloy and a cobalt-based alloy.

13. An article according to claim 12, wherein said thermal insulation layer comprises a ternary oxide with oxygen as a third element.

14. An article according to claim 13, wherein a first element of said ternary oxide is one of nickel, magnesium and cobalt, and a second element of said ternary oxide is one of aluminum and chromium.

15. An article according to claim 13, wherein a first element of said ternary oxide is one of calcium and lanthanum, and a second element of said ternary oxide is one of aluminum, zirconium and hafnium.

16. An article according to claim 13, further comprising a binding layer between said ceramic thermal insulation layer and said bonding layer, said binding layer comprising lanthanum oxide in combination with at least one of aluminum oxide, chromium oxide and hafnium oxide.

* * * * *